United States Patent [19]

Sano et al.

[11] Patent Number: 4,556,336

[45] Date of Patent: Dec. 3, 1985

[54] PEN CORE FOR WRITING INSTRUMENT

[75] Inventors: Tsunenori Sano; Kazuo Kawaguchi, both of Kanagawa, Japan

[73] Assignee: Pilot Man-Nen Hitsu Kabushiki Kaisha, Tokyo, Japan

[21] Appl. No.: 616,041

[22] Filed: Jun. 1, 1984

[30] Foreign Application Priority Data

Jun. 3, 1983 [JP] Japan ..... 58-84988[U]
Jul. 29, 1983 [JP] Japan ..... 58-119410[U]

[51] Int. Cl.[4] ..... B43K 8/02; B43K 3/00

[52] U.S. Cl. ..... 401/199; 401/224; 401/225; 401/227; 401/242

[58] Field of Search ..... 401/196, 198, 199, 258, 401/242, 225, 226, 227, 228, 229, 224

[56] References Cited

U.S. PATENT DOCUMENTS

| | | | |
|---|---|---|---|
| 2,260,571 | 10/1941 | Johndohl | 401/242 |
| 2,766,728 | 10/1956 | Kouacs | 401/241 |
| 3,411,854 | 11/1968 | Rosler et al. | 401/227 |
| 4,239,408 | 12/1980 | Mutschler | 401/217 |

FOREIGN PATENT DOCUMENTS

| | | | |
|---|---|---|---|
| 2448048 | 5/1979 | Fed. Rep. of Germany | 401/258 |
| 2808910 | 9/1979 | Fed. Rep. of Germany | 401/258 |
| 2462274 | 3/1981 | France | 401/199 |
| 601782 | 2/1960 | Italy | 401/227 |
| 57-18295 | 1/1982 | Japan | 401/199 |
| 941439 | 11/1963 | United Kingdom | 401/198 |
| 1039667 | 8/1966 | United Kingdom | 401/199 |

*Primary Examiner*—Steven A. Bratlie
*Attorney, Agent, or Firm*—Sughrue, Mion, Zinn, Macpeak & Seas

[57] ABSTRACT

A pen core for a writing instrument, particularly, for use in a recorder in which writing must be continuously carried out over long periods using a relatively small ink supply. The instrument has an ink conducting core for conducting ink to a writing member, and a barrel with an ink reservoir, the barrel being fitted on the outer wall of the pen core body. An annular groove in the form of a single continuous passageway is formed in the outer wall of the pen core body, the annular groove having a front end connected to an ink sucking groove, which is in turn communicated with the ink conducting core. An air passageway having a front end communicated with an air hole and a rear end communicated with the rear end of the annular groove is formed in the outer wall of the pen core body in such a manner that the air passageway does not cross the annular groove.

3 Claims, 3 Drawing Figures

PEN CORE FOR WRITING INSTRUMENT

BACKGROUND OF THE INVENTION

The present invention relates to a pen core for a writing instrument, which has an ink conducting core for conducting ink to the writing member of the instrument.

Recently, a liquid-type writing instrument having an ink conducting core adapted to conduct ink to the writing member and a barrel with an ink reservoir which is fitted to the outer wall of a cylindrical pen core body has been extensively employed, for instance, as a plotter pen. In order to prevent the ink from dripping down the writing member upon a temperature change or an impact exerted thereon, the writing instrument employs a fountain pen type pen core which has a number of parallel, annular grooves, an ink groove crossing these grooves, and an air groove. Also, a spiral-type pen core has been used which has a spiral groove for communicating the ink reservoir with the writing end and the atmosphere. The parallel, annular grooves, or the spiral groove, are used as an ink pool to retain excess amounts of ink. The fountain pen type is disadvantageous in that, as an excess quantity of ink from the ink groove flows into the annular grooves simultaneously, such ink tends to collect in the annular grooves at the front ends thereof during the writing operation, flowing to the front end portion of the air groove communicated with the annular grooves and obstructing the air flow therein. Furthermore, the ink may flow out of the air groove if an impact is exerted on the pen core. Further, the spiral-type pen core is disadvantageous in that as the spiral groove is communicated with the air outlet at the front end and with the ink reservoir at the rear end, excess ink pooled temporarily is liable to flow down towards the front end of the pen core upon an impact applied thereto or by force of gravity during the writing operation, thus obstructing the air flow. Furthermore, the ink may flow out of the air groove if an impact is exerted on the pen core. Thus, in each of the above-described pen cores, the excess ink retained temporarily is liable to flow down to the front end of the pen core, even if the ambient temperature is constant and the pen is protected from impact forces. Therefore, ink tends to gradually collect near the front end of the pen core without completely returning to the ink reservoir with which the pen core is communicated at the rear end. As a result, the ink thus collected can obstruct the flow of air and drip out. Thus, such pen cores are not always satisfactory in performance.

In a writing instrument with a conventional pen core, an arcuate ink layer is formed by surface tension along the annular corner which is formed by the inner wall of the ink reservoir and the rear end face of the pen core body. When the level of ink in the ink reservoir becomes lower than the ink conducting core when the pen is held horizontally, the supply of ink to the ink conducting core is stopped. Thus, economical use of ink cannot be expected, and hence a writing instrument with the conventional pen core is not suitable as a liquid-type writing instrument which is installed, for instance, on a plotter in which writing operations must be carried out over long periods using only a small ink reservoir.

SUMMARY OF THE INVENTION

Accordingly, an object of the invention is to provide a pen core for a writing instrument in which the above-described difficulties are eliminated such that, when the temperature or pressure changes, or especially when an impact is exerted thereon, excess ink flow out of the writing end part or the air hole and blocking of the air flow are prevented so that writing is not interrupted and all the ink in the ink reservoir can be used.

A specific feature of the invention resides in that, unlike the conventional pen core, a single labyrinth type annular groove is formed in the outer wall of a pen core body, the annular groove being communicated with an ink sucking groove at the front end and with an air passageway at the rear end, the annular groove thus formed is combined with an ink conducting core providing a strong capillary effect, and grooves providing a capillary action are formed radially in the rear end face of the pen core body in communication with the ink conducting core. Accordingly, excess ink is pooled in the annular groove beginning from its front end portion. When the external force is eliminated, the ink is quickly returned. The ink remaining in the ink reservoir can thus be effectively used.

The pen core according to the invention can be applied to any writing instrument using ink such as a solution type ball point pen, felt pen, fountain pen or recording pen.

In the pen core according to the invention, the barrel may be integral with a neck, or the neck may be formed separately from the barrel so that the former is combined with the latter.

DESCRIPTION OF THE PREFERRED EMBODIMENTS

A preferred embodiment of the invention will now be described with reference to the accompanying drawings.

Figure 1:
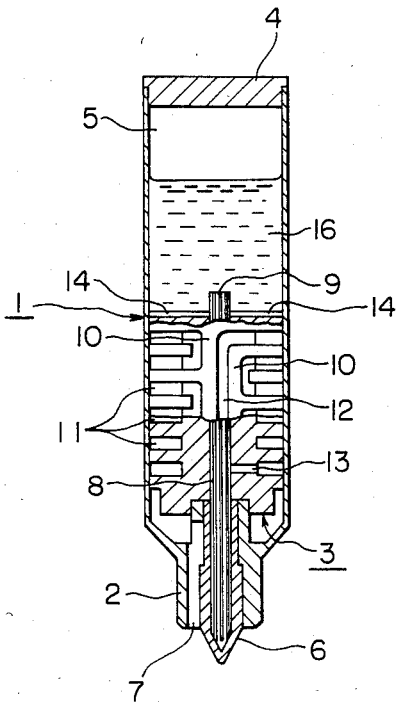
FIG. 1 is a longitudinal sectional diagram, with parts cut away, showing a preferred embodiment of the invention.
Figure 2:
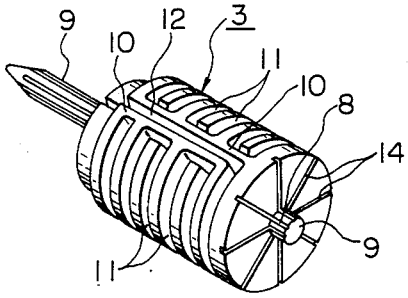
FIG. 2 is a perspective view showing a pen core body and an ink conducting core.

In FIGS. 1 and 2, reference numeral 1 designates a barrel which is in the form of a cylinder opened at the rear end. The front end portion of the barrel 1 is formed into a cylindrical neck 2 of smaller diameter than the main portion of the barrel. A pen core body 3 is inserted into the barrel 1 with its outer wall in close contact with the inner wall of the barrel behind the neck 2. The barrel 1 is sealed by a plug 4 at the rear end so that the rear half of the barrel 1 is used as an ink reservoir 5. A writing tip 6 rotatably holding a ball is inserted into the neck 2, and an air hole 7 is formed in the neck 2. An ink conducting core 9 is inserted into the central hole 8 of the pen core body 3. The ink conducting core 9 has a front end portion inserted into the writing tip 6 so that the ink is conducted to the ball at the front end. The rear end of the core extends into the ink reservoir 5. An annular groove 11 with both ends closed is formed in the outer wall of the pen core body 3, providing banks 10. The annular groove 11 is one continuous passageway which is bent and turned as in a labyrinth structure.

An air passageway 12 is formed in the bank 10 extending longitudinally in such a manner that its front end communicates with the air hole 7 and its rear end with the rear end of the annular groove 11. The passageway 12 is formed in the same outer wall as the annular groove 11 without crossing the latter. The front end of the annular groove 11 is connected to an ink sucking groove 13, which is communicated with the ink conducting core 9 in the central hole 8. Grooves 14 providing a capillary effect are formed radially in the rear end face of the pen core body 3, communicating with the ink conducting core 9 inserted into the central hole 8 of the pen core body 3. An annular chamber or groove may be formed in the periphery of the rear end face.

Figure 3:
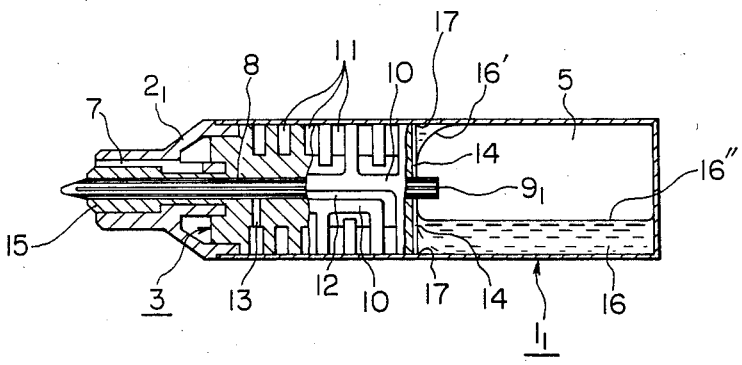
FIG. 3 is a longitudinal sectional view, with parts cut away, showing another embodiment of the invention.

FIG. 3 shows another example of the pen core. The pen core in FIG. 3 differs from that in FIGS. 1 and 2 only in that a barrel $1_1$ in the form of a bottomed cylinder is not integral with its neck $2_1$, the front end portion of an ink conducting core $9_1$ is inserted into a holder 15 fitted in the neck $2_1$ in such a manner that it extends from the holder 15 and is used as a writing member, and the writing instrument is held horizontally.

With the pen core coupled to the writing instrument, the ink 16 in the ink reservoir 5 flows along the ink conducting core 9 to the writing end part, while air flows through the air hole 7, the air passageway 12, the annular groove 11, the ink sucking groove 13 and the ink conducting core 9, and the gap between the central hole 8 and the ink conducting core 9 into the ink reservoir 5 so that the pressure in the ink reservoir 5 is suitable to allow continuous writing.

If an excess amount of ink 16 flows into the ink conducting core 9 due to a temperature or atmospheric pressure change or impact, such ink flows from the ink sucking groove 13 to the annular groove 11, and hence there is no excessive ink flow to the writing end member. Furthermore, as the ink collects in the annular groove beginning from its front end, it will never flow out through the air passageway 12 communicated with the annular groove at the rear end. With ink sucking groove 13 coupled to the front end of the annular groove as described above, when the temperature or atmospheric pressure is restored normal or the impact is eliminated, all the ink 16 retained in the annular groove 11 is returned to the ink reservoir 5 due to the capillary action of the ink conducting core 9, and therefore the air flow will not be obstructed. Especially in a writing operation in which the pen core is held downwardly, this effect is significant.

On the other hand, when the ink 16 is consumed so that an arcuately shaped portion formed by surface tension along the annular corner 17 comes below the ink conducting core 9 (or 9'), the ink portions 16 and 16' are conducted into the radial grooves 14 due to the capillary action, and into the ink conducting core 9 (or 9') which provides a stronger capillary action. Thus, substantially all the ink is supplied to the writing end member.

With the pen core of the invention constructed as described above, even if the temperature or atmospheric pressure changes or an impact is exerted theron, the ink will not drip down from the writing end member and will not flow out of the air hole. Furthermore, obstruction of the air flow, causing a discontinuous flow of ink to the writing end member is prevented. In addition, substantially all the ink in the ink reservoir is supplied to the writing end part. As the number of components of the pen core is small, the pen core is small in size. Therefore, the pen core of the invention is considerably effective for use as a liquid ink type writing instrument in, for instance, a plotter in which a writing operation must be carried out with a small writing instrument for long periods. For the same reason, the pen core can be manufactured at low cost.

We claim:

1. In a pen core for a writing instrument having an ink conducting core for conducting ink to a writing member thereof and a barrel with an ink reservoir, said barrel being fitted on the outer wall of a pen core body, the improvement wherein: an annular groove in the form of a single continuous passageway is formed in the outer wall of said pen core body, said annular groove having a front end connected to an ink sucking groove which is communicated with said ink conducting core, and an air passageway having a front end communicated with an air hole and a rear end communicated with the rear end of said annular groove is formed in the outer wall of said pen core body without crossing said annular groove;

wherein said annular groove has the form of a single continuous passageway formed in the outer wall of said pen core body, said continuous passageway being bent and turning in a labyrinth structure and leaving banks, and wherein said air passageway is formed in a longitudinal one of said banks.

2. The pen core for a writing instrument as claimed in claim 1, wherein grooves providing a capillary action are formed in the rear end face of said pen core body, said grooves communicating with said ink conducting core.

3. The pen core for a writing instrument as claimed in claim 2, wherein grooves providing said capillary action are formed in the rear end face of said pen core body, said grooves communicating with said ink conducting core.

* * * * *